US006408671B1

(12) United States Patent
Knödler

(10) Patent No.: US 6,408,671 B1
(45) Date of Patent: Jun. 25, 2002

(54) HYDROMECHANICAL DRIVE OF A CROSS-SHEARING STATION

(75) Inventor: Richard Knödler, Schwäbisch Gmünd (DE)

(73) Assignee: Schuler Pressen GmbH & Co. KG, Goppingen (DE)

( * ) Notice: Subject to any disclaimer, the term of this patent is extended or adjusted under 35 U.S.C. 154(b) by 0 days.

(21) Appl. No.: 09/679,520

(22) Filed: Oct. 6, 2000

(30) Foreign Application Priority Data

Oct. 6, 1999 (DE) ..... 199 48 002

(51) Int. Cl.[7] ..... B21D 28/00
(52) U.S. Cl. ..... 72/332; 72/338; 72/453.02
(58) Field of Search ..... 72/332, 340, 338, 72/337, 334, 453.02, 356, 403, 20.2

(56) References Cited

U.S. PATENT DOCUMENTS 1,633,970 A * 6/1927 Ball
4,357,816 A * 11/1982 Antonov ..... 72/453.02
5,115,663 A * 5/1992 Ando ..... 72/356
5,295,381 A * 3/1994 Nishikawa ..... 72/453.02
5,606,887 A * 3/1997 Spiegelberg ..... 72/356

* cited by examiner

*Primary Examiner*—Daniel C. Crane
(74) *Attorney, Agent, or Firm*—Crowell & Moring LLP

(57) ABSTRACT

A press has a tool which comprises an upper tool part and a lower tool part. The upper tool part is held on the press slide, while the lower tool part is stationarily mounted in the press frame. A movable forming element, such as a shearing blade, is provided in the lower tool part. The press drive is used for driving the shearing blade. For this purpose, a hydraulic force transmitting device is provided in the lower tool part and is actuated by way of a pressure pin. For the actuation, the slide or an element fixedly connected with the slide is used, the slide, in turn, being driven by the press drive. A hydraulic force transmitting device in the lower tool part permits a liberal tool construction and an arrangement of corresponding force transmitting devices for the at least temporary coupling between the slide and the hydraulic force transmitting device at points which hinder neither the access to the tool nor the workpiece transfer.

11 Claims, 6 Drawing Sheets

HYDROMECHANICAL DRIVE OF A CROSS-SHEARING STATION

BACKGROUND OF THE INVENTION

This application claims the priority of German Patent Document No. 199 48 002.8, filed in Germany on Oct. 6, 1999, the disclosure of which is expressly incorporated by reference herein.

The present invention relates to a press, particularly to a press for massive forming.

Particularly in presses provided for massive forming, multi-station tools are frequently used. Workpieces travel through several tool stations successively. The traveling workpiece experiences a forming step in each tool station. The formings are achieved by a relative movement between the top tool and the bottom tool. The top tools of the tool stations are usually carried by a single common slide and therefore move synchronously in the same direction. Occasionally, however, forming operations are desired which require a movement of a movable member existing in the tool in a direction which deviates from the moving direction of the slide. Such movement is, for example, the movement of a shearing member by which edges, shaft ends or the like are cut off a correspondingly shaped workpiece. Such shearing operations must frequently be carried out in the last tool station. In this case, the movement of the shearing element takes place, for example, transversely to the linear movement of the slide.

In the working space of a corresponding press for massive forming, one or several transfer devices are also accommodated in addition to the tool. The transfer devices cause the transport of the workpieces from one press station to the next. The tools must leave a corresponding space for the transfer device. The transfer device is arranged along the tools, for example, on one of their sides. The opposite other side is required for the access to the tools. Therefore, when a movable tool existing in one tool part is to be connected with a driving device, these restrictions with respect to the existing space and the spaces to be kept free must be observed.

SUMMARY OF THE INVENTION

An object of the present invention is to provide a press with a suitable drive for a movably disposed forming element existing in the tool.

This object has been achieved by a press, particularly press for massive forming, having a press frame in which or on which a slide is movably disposed and is connected with a drive, having a workpiece receiving space in which the tool is arranged which has at least two tool parts having a forming device for which at least one forming element is arranged which is movably arranged in one of the tool parts, having a hydraulic force transmitting device which is connected with the forming element and is driven by the driving device.

The press according to the present invention has a tool receiving space in which a tool is arranged. The tool is divided into an upper and into a lower tool part. The upper tool part is connected with the slide of the press, while the lower tool part rests in the press. The tool may contain one or several tool stations. Furthermore, it is contemplated to provide a separate tool for each tool station, which tool will then, in each case, be divided into a lower and upper tool part. In this embodiment, the upper tool parts are connected with the slide and the lower tool parts, in turn, are connected with a bedplate. Furthermore, within the scope of the invention, it is also possible to provide only a single tool for a single forming station in the press. Irrespective of how many tool stations are arranged in the tool receiving space of the press, at least one forming element is present which is movably arranged in one of the tool parts and is driven by way of a hydraulic force transmitting device by the driving device of the press. This forming element has the purpose of, in addition to the forming movement, which is generated by the relative movement of the tool parts toward one another, carry out at least one other forming operation. Such a forming operation may, for example, be a shearing operation. At least one of the tool stations will then contain a shearing member which, at a desired point in time, carries out in a hydraulically operated manner a shearing operation on the workpiece. As a result, for example, in the last forming station, shaft ends, edges or other sections to be removed from the workpiece can be cut off.

As required and depending on its function and configuration, the forming element can be moved along a straight path or along a curved path. The fluid drive pertaining to the hydraulic force transmitting device is to be selected correspondingly. If a linear movement is required, a piston/cylinder arrangement is advantageously selected.

The hydraulic force transmitting device can be connected with the driving device in different manners. A particularly space-saving variant, which is easy to mount with respect to the tool, is obtained if the hydraulic force transmitting device is actuated by the slide. This slide establishes the required connection between the driving device and the hydraulic force transmitting device.

The hydraulic force transmitting device permits a flexible configuration so that otherwise required space can remain free. Furthermore, the working direction of the forming element can be advantageously liberally defined within wide limits. If the forming element is a shearing member, its working plane and working direction can be determined independently of the spatial arrangement of the hydraulic force transmitting device and particularly of its inlet section.

By the coupling of the forming element with the driving device by way of the hydraulic force transmitting device, a forced synchronization is caused between the slide and the forming element. A continuous coupling of the force transmitting device to the slide is not necessary. It is sufficient for this coupling to be established only when force is also to be transmitted.

The hydraulic force transmitting device comprises a pumping device which can be actuated, for example, by the slide, as well as a transmitting device which can be formed by fluid ducts in the corresponding tool part, and a fluid drive which is fed by way of the ducts and which is connected with the forming element. In this case, the fluid drive is preferably not fixedly connected with the forming element but only rests against it, so that the shearing forces are transmitted. This simplifies the tool construction and in a simple manner permits the demounting.

In most cases, the forming element is arranged in the bottom tool and is actuated in the proximity of the lower pressure point of the slide. In principle, it is also possible to provide such forming elements or forming devices in the top tool. In both cases, it is expedient for the hydraulic force transmitting devices to be actuated by a coupling device. The slide, for example, can be placed by way of a corresponding thrust piece (impact driver) on a push rod by way of which the force transmitting device is actuated. This will be useful when the forming element and the force transmitting device are accommodated in the lower tool part. If they are situated in the upper tool part, the corresponding push rod can, during the downward stroke of the upper tool part, be placed on a stationary stop, whereby, in turn, the actuation is triggered.

It is advantageous to combine the hydraulic force transmitting device with an overload safety device and, if necessary, combine the latter with a machine switch-off device. As a result, damage to the tool can be avoided.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
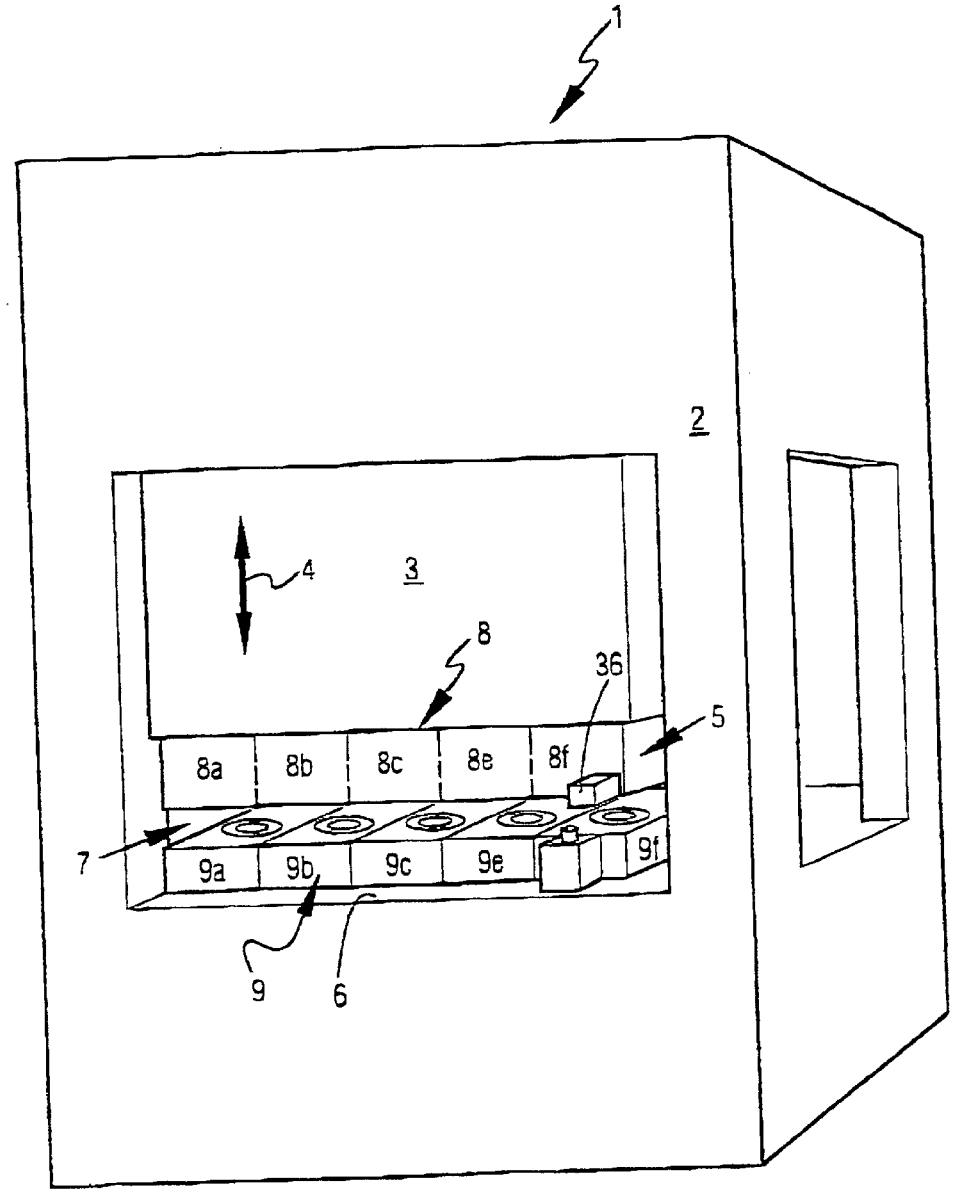
FIG. 1 is a schematic perspective view of a press for massive forming.

FIG. 1 illustrates a press 1 in whose press frame 2 a slide 3 is movably displaced, moving back and forth in a direction indicated by an arrow 4. A known type of driving device, which is not described in greater detail, can be used for driving the slide 3. This driving device may comprise, for example, a motor, a step-down gear, an eccentric and a lever transmission.

Figure 2:
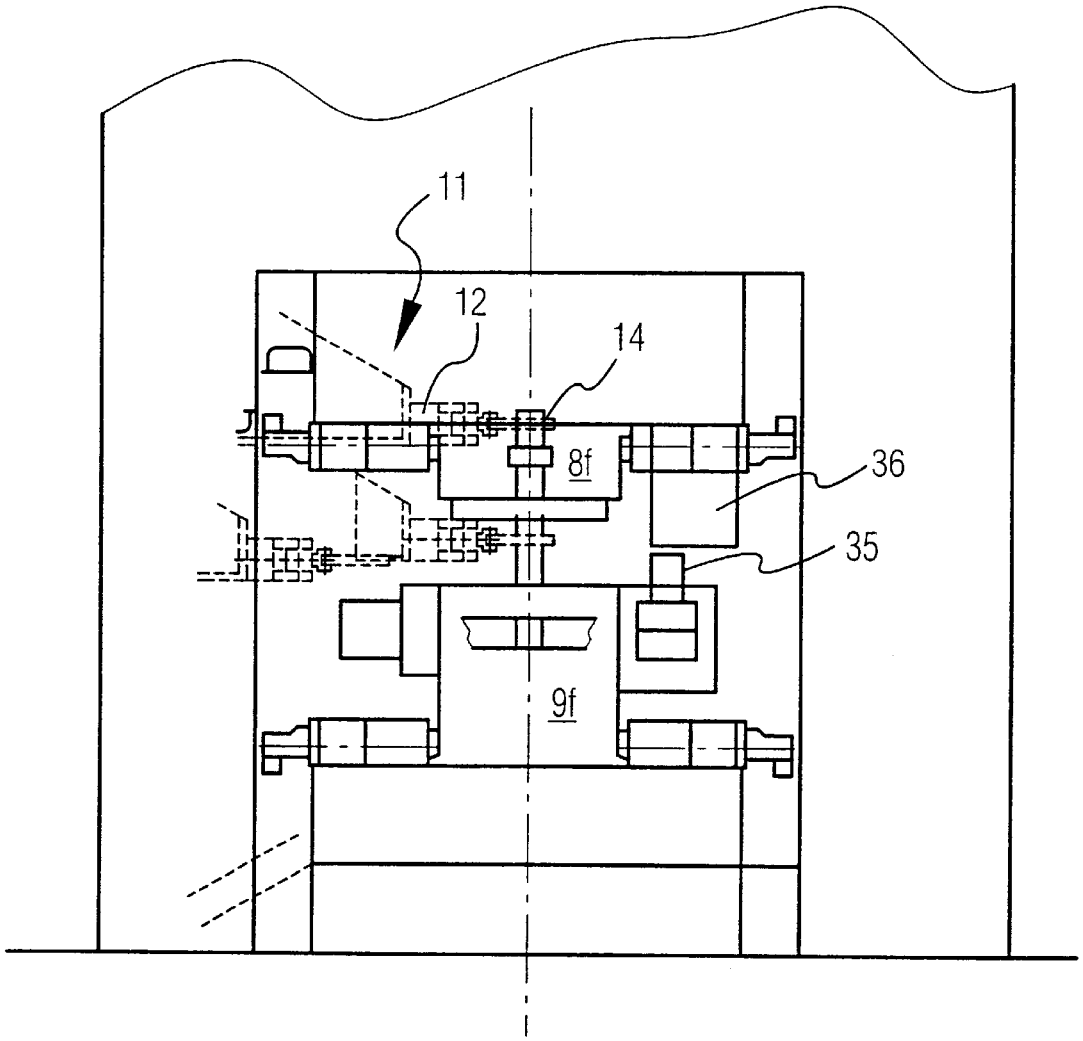
FIG. 2 is a cutaway side view of the press according to FIG. 1.

Below the slide 3, a tool installation space 5 is provided which is bounded in the downward direction by a bedplate 6. In the tool installation space 5, a tool 7 is arranged which comprises a tool top part 8 and a tool bottom part 9. The tool top part 8 and the tool bottom part 9 may, in each case, be divided into tool stations so that corresponding tool top parts 8*a*, 8*b*, 8*c*, 8*e*, 8*f* and tool bottom parts 9*a*, 9*b*, 9*c*, 9*e*, 9*f* are provided. In pairs, to tool parts 8*a*, 9*a* to 8*f*, 9*f* each define a forming station. A workpiece travels successively through these tool stations. A transfer device 11, whose gripper 12 is illustrated in FIG. 2, is used for transporting the workpiece. One gripper 14, for example, is provided for each tool station and, as illustrated in FIG. 2, can carry out the transfer movement from one tool station to the next.

Tool station 8*f*, 9*f* is illustrated in detail in FIGS. 3 to 6. The lower tool part 9*f* contains a slider 15 which is called a shearing blade and which is disposed to be displaceable in a linear manner in the direction of an arrow 16 illustrated in FIG. 3 transversely to the working direction of the slide 3 (see FIG. 1, arrow 4). In the illustrated embodiment, the slide 3 moves in the vertical direction, while the shearing blade 15 can be moved in a horizontal plane transversely to the transfer direction of the workpieces. For this purpose, the slider 15 is inserted in a guide 16*a* which supports and guides the slider laterally and vertically upward and downward. However, the slider 15 is freely displaceable in the longitudinal direction. The slider 15 is provided with a shearing bush 17 which has an opening 18. The opening is adapted to the shape of the workpiece part to be cut off and has, for example, a round construction.

A tool-fixed bush 21 (FIG. 5) is assigned to the bush 17 which is movable with the slider 15, and the opening 22 of the bush 22 is aligned with the opening 17 when the shearing blade 15 is in an inoperative position. A hydraulic force transmitting device 23 is additionally assigned to the shearing blade 15 which, in addition to the top tool 9*f* or instead of it, constitutes a forming element. This force transmitting device 23 is used for the force transmission from the slide 3 to the shearing blade 15 and thus finally for the force-related connection between the drive of the press 1 and the shearing blade 15.

Figure 3:
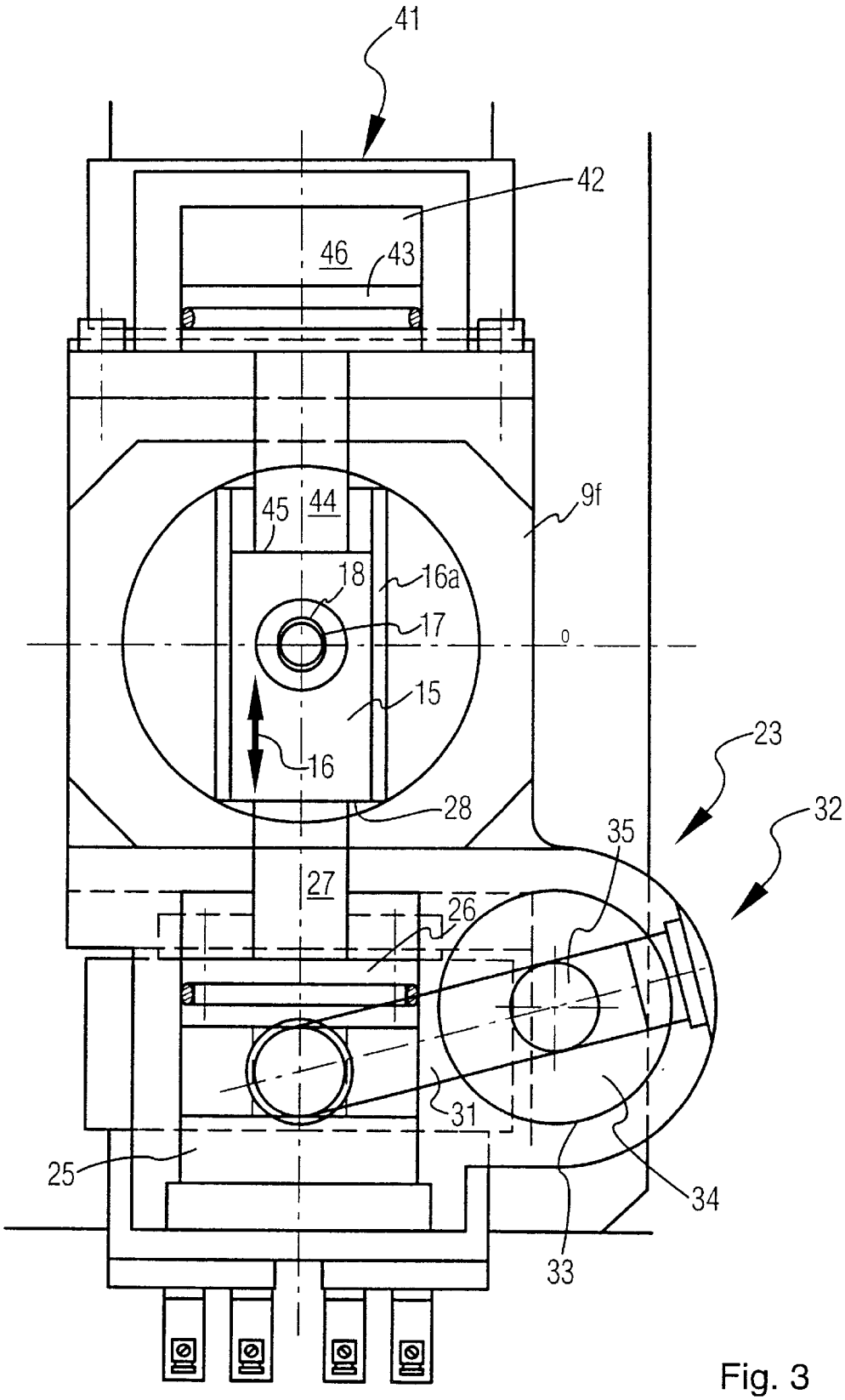
FIG. 3 is a cutaway top view of a bottom tool press tool according to FIGS. 1 and 2.
Figure 4:
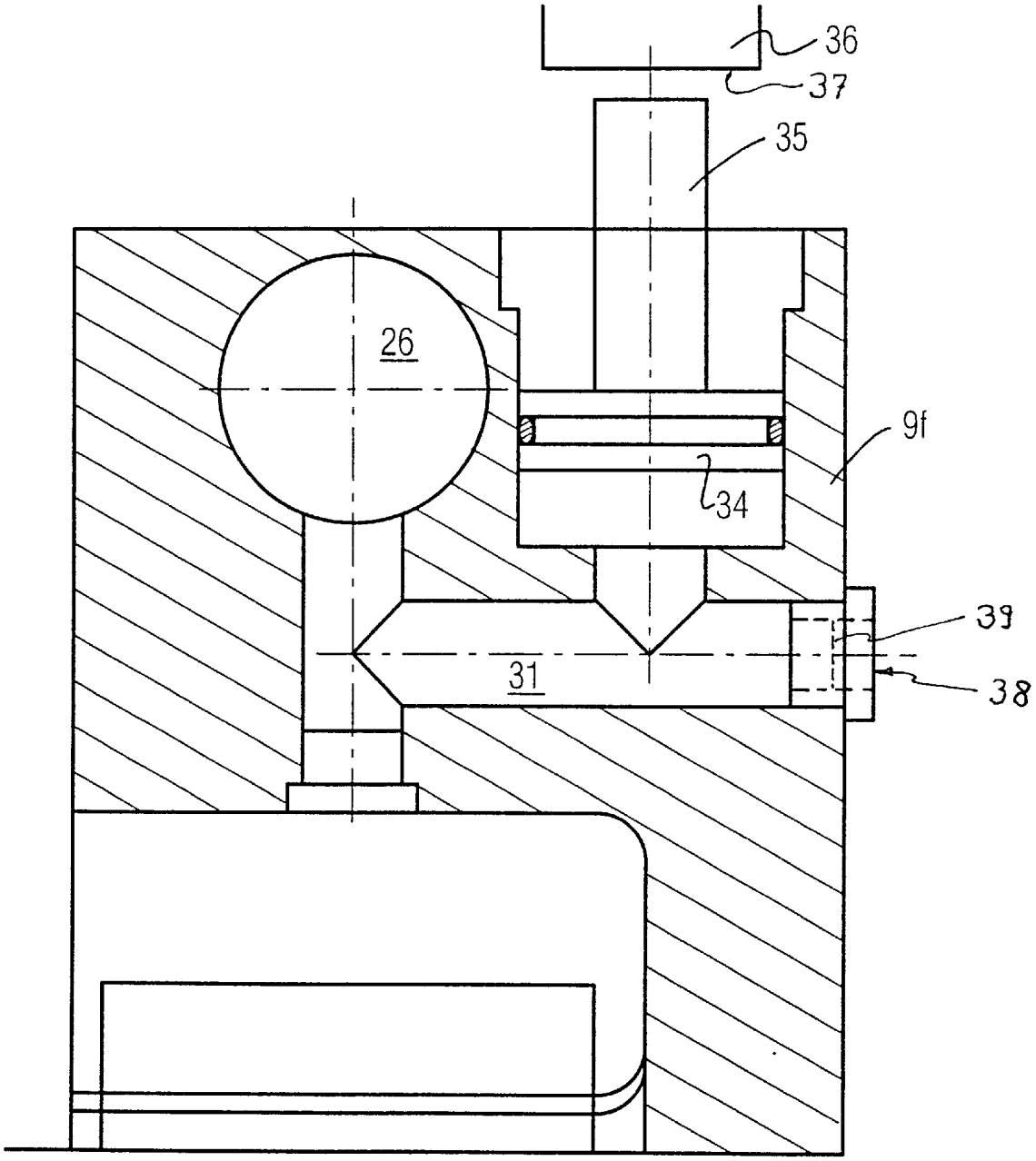
FIG. 4 is a schematic vertical sectional view of the tool according to FIG. 3.

The hydraulic force transmitting device 23 comprises a fluid drive 24 which is formed by a hydraulic cylinder 25 housed in the lower tool part 9*f* and a piston 26 which is displaceably disposed therein in a sealed-off manner. The piston 26 has a piston rod 27 which is supported on a face 28 of the shearing blade 15. The piston 26 defines a working space 29 in the hydraulic cylinder 25. This working space 29 is connected by way of a duct 31 with a pumping device 32. As illustrated in FIG. 3, this pumping device 32 is formed, for example, again by hydraulic cylinder 33 in which a piston 34 is disposed in a sealed-off and displaceable manner. In this case, the piston 34 can preferably be displaced in a direction which corresponds to the working direction 4 of the slide 3.

The pumping device 32 is preferably arranged at a point on the bottom tool 9*f* which is not reserved for other devices, such as the transfer device 11 or for the access to the bottom tool 9*f*. In the present embodiment, that is a corner of the bottom tool 9*f* which, in the-top view, is framed approximately at a right angle. The arrangement can be selected according to aspects of practicality, in which case the duct 31 can extend almost arbitrarily.

Figure 5:
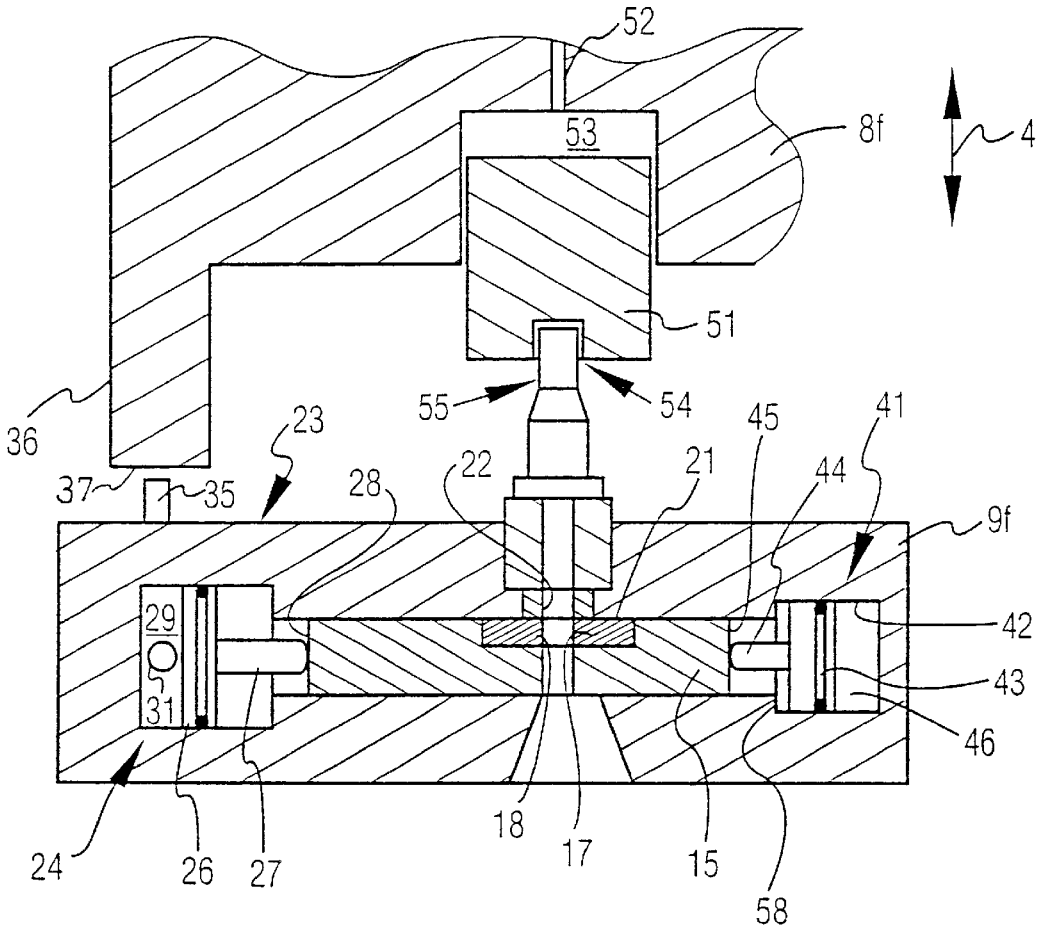
FIG. 5 is a schematic horizontal sectional view of the tool with a workpiece just before the end of the downward stroke of the top tool.
Figure 6:
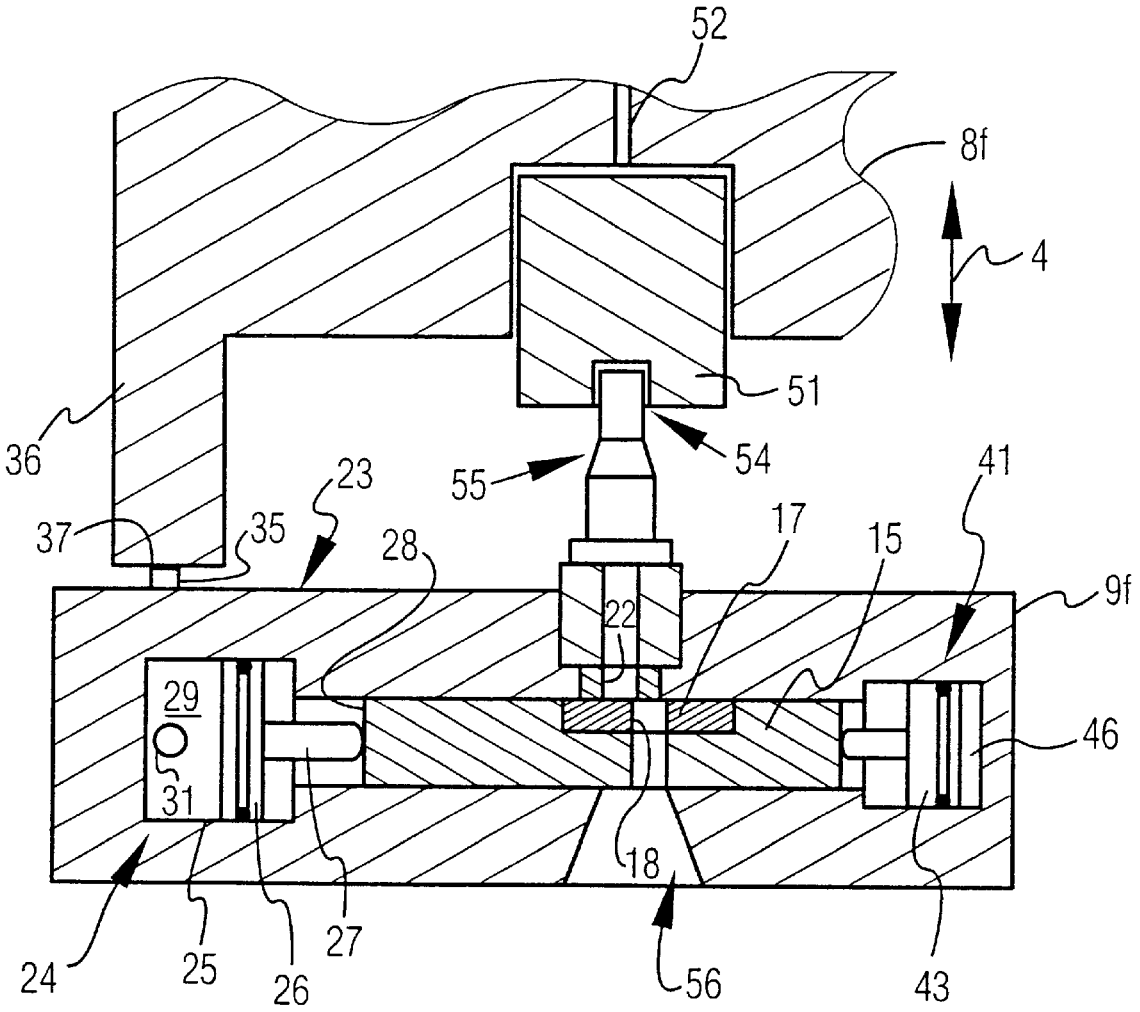
FIG. 6 is a schematic horizontal sectional view of the tool according to FIG. 5 when reaching the lower dead center of the slide.

The piston 34 is provided with a pressure pin 35 which, as illustrated in FIGS. 5 and 6, projects out of the bottom tool 9*f*. An impact driver 36, which is connected with the slide or the top tool 8*f*, is assigned to the pressure pin 35. The impact driver 36 has an essentially plane underside 37 facing the pressure pin 35 and is arranged such that it is placed, just before the lower dead center of the slide 3, by way of its plane surface 37 on the upper face of the pressure pin 35.

The hydraulic force transmitting device 23 is closed in itself. In this advantageous embodiment, the hydraulic circulation system is accommodated completely in the tool, that is, completely in the lower tool part 9*f*. Alternative embodiments, in which connections extend to the outside and the driving power is acted upon, for example, by the main press shaft by way of a cam disk and a pump operated by the cam disk are, however, also contemplated. However, the present embodiment with the hydraulic circulating system accommodated completely in the lower tool part 9*f* has the advantage that a separation of the hydraulic circulating system is not necessary during the tool change.

For protecting the tool 9*f* against an overload, the hydraulic force transmitting device 23 can be provided with an overload protection device which opens up an outlet 38 when a maximal pressure is exceeded in the spaces of the force transmitting device 23 filled with hydraulic fluid. This outlet 38 can be formed by a duct leading from the interior of the force transmitting device 23 into the open air. The overload protection device will then be formed, for example, by a bursting disk 39 which blocks the outlet and which breaks or detaches when the bursting pressure is exceeded and opens up the outlet 38. Instead of the bursting disk 39, a pressure relief valve can be used under certain circumstances.

It is advantageous to monitor the overload protection device. For this purpose, an electric contact can, for example, be provided which opens or closes when the bursting disk (or pressure relief valve) responds. This signal can be supplied to the machine control system or to the main drive, in each case in order to stop the main drive preferably in the upper dead center.

In the present embodiment, the pistons 26, 34 have the same diameter so that, after the impact driver 36 is placed on the pressure pin 35, the movement of the slide 3 is transmitted 1:1 (that is, with the same paths and forces) to the shearing blade 15. Various configurations which cause a step-down or step-up are, however, conceivable by a corresponding selection of the piston diameters. Also, a pumping device can actuate several fluid drives for several forming elements in the respective tool part.

In addition to the hydraulic force transmitting device 23, a spring device 41 is assigned to the shearing blade 15. The spring device 41 holds the shearing blade 15 in contact with the piston rod 27 and is used as a return stroke or restoring device. The spring device 41 can, for example, be formed by a pneumatic device which comprises a pneumatic cylinder 42 constructed in the bottom tool 9*f* and a piston 43 which is disposed to be displaceably movable in a sealed-off manner in this pneumatic cylinder 42. The spring device 41 is preferably arranged on a side of the shearing blade 15 which is situated opposite the hydraulic driving device 24. The piston 43 can be aligned with the piston 26 and has a piston rod 44 in the form of a short pin which rests against an end-side plane surface 45 of the shearing blade 15. The shearing blade 15 is therefore held without play between the piston rods 27, 44.

In the pneumatic cylinder 42, the piston 43 partitions off a working volume 46 which is under a constant or controlled pressure. If only a defined time-constant pressure is required, the spring device 41 can be connected with a buffer volume which is kept under a constant pressure. In practice, this can be achieved by a connection with a compressed-air supply system. (In simple variants, the spring device 41 may also be formed by a pressure spring (coil spring) or a similar device.) The working direction of the spring device 41 corresponds to the working direction of the hydraulic driving device 24.

In the shearing station illustrated in FIGS. 5 and 6, the top tool 8*f* comprises a holding piston 51 which is displaceable in the top tool 8*f* in a direction which corresponds to the working direction of the slide 3. By way of a duct 52, a working space 53 defined by the holding piston 51 can be acted upon by pressure. On its underside, the holding piston 51 is provided with a recess 54 which can receive a section of a workpiece 55. A downward-extending section of the workpiece 55 projects into the openings 22, 18.

During the operation of the press 1, the slide 3 of the press 1 is moved continuously up and down in the direction of the arrow 4. The workpieces 55 are successively timed through the tool positions marked a to f. The workpiece 55 situated in the last tool station projects by way of a shaft journal through the opening 22 into the opening 18. For this purpose, the spring device 41 has moved the openings 22, 18 into an alignment as seen in FIG. 5. The pressure pin 35 projects freely upward and, during the downward stroke of the slide 3, the impact driver 36 moves toward the slide 3. The holding piston 51 then first finds, by way of its recess 54, the upward extending section of the workpiece 55 and is hindered thereby from carrying out the continued downward movement. The fluid flowing out by way of the duct 52 generates a force such that the holding piston 51 presses the workpiece 55 against the bottom tool 9*f*.

During the continued movement of the slide 3, the impact driver 36 is placed on the pressure pin 35 just before the lower dead center of the slide 3 and, as illustrated in FIG. 6, presses the pressure pin 35 downward. The resulting movement of the piston 34 pumps hydraulic fluid 31 into the working space 29. As a result, the piston 26 is displaced. The associated push rod or its piston rod 27 presses the shearing blade 15 into the position illustrated in FIG. 6, in which the opening 18 is displaced with respect to the opening 22. As a result, the shearing bush 17 cuts off the part of the workpiece 55 extending into the opening 18. It can fall downward a scrap chute 56.

With the displacement of the shearing blade 15, the piston 43 was also displaced against the pressure of the fluid enclosed in the chamber 46. The fluid, which is compressed in the working space 46 and may be connected with an outside volume, presses against the piston 43 and, after the shearing-off of the shaft end, prevents an uncontrolled movement of the shearing blade 15. It therefore acts as a damper and buffer.

When the slide 3 has traveled through its lower dead center, the impact driver 36 moves away from the bottom tool 9*f*. The piston 34 can therefore carry out an upward movement again (FIG. 4), whereby, under the effect of the pneumatic pressure, the piston 43 can push the shearing blade 15 and the piston 26 back into its starting position. This is illustrated in FIG. 5 in which the bores 18, 22 are aligned again.

A stop device can be provided for defining this starting position. For this purpose, a ring shoulder 58 can, for example, be constructed at the end of the cylinder bore of the cylinder 42 and on which the piston 43 is placed. As required, for facilitating the alignment of the bores 18, 22 with respect to one another, the bore 18 can be constructed with a certain overdimensioning. Furthermore, the bore may deviate from the circular shape and may, for example, have an oval construction. This permits a certain positioning tolerance of the shearing blade 15 with respect to its displacement direction. The adjustment of the starting position (inoperative position) of the shearing blade can optionally also be considerably facilitated by an adjustable stop device. This stop device can interact directly with the shearing blade. If the (pump) piston 34 has a fixed stop, the adjusting can also take place by adjusting the hydraulic volume.

The press 1 has a tool which comprises an upper tool part 8*f* and a lower tool part 9*f*. The upper tool part 8*f* is held on the press slide 3, while the lower press part 9*f* is stationarily mounted on the press frame 2. A movable forming element, such as a shearing blade 15, is provided in the lower tool part 9*f*. The press drive is used for driving the shearing blade 15. For this purpose, a hydraulic force transmitting device 23, which is actuated by a pressure pin 35, is provided for in the lower tool part 9*f*. For the actuating, the slide or an element 36 fixedly connected with the slide is used, the slide itself being driven by the press drive.

The hydraulic force transmitting device in the lower tool part 9*f* permits a liberal tool construction and the arrangement of corresponding force transmitting devices 35, 36 for the at least temporary coupling between the slide 3 and the hydraulic force transmitting device 23 at points which neither hinder the access to the tool nor the workpiece transfer.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A press for operations which include massive forming, comprising:

a press frame with which a slide is movably disposed and is operatively connected with a driving device, a workpiece receiving space in which a tool having at least two tool parts is operatively arranged for deforming a workpiece in said press has been inserted after arranged;

a forming device for which at least one forming element is movably arranged in one of the tool parts; and a driven hydraulic, valveless force transmitting device operatively connected with the forming element to control a working stroke of the for deforming a workpiece in said press.

2. Press according to claim 1, wherein the hydraulic force transmitting device is connected, at least temporarily, via the slide with the driving device.

3. Press according to claim 1, wherein the forming element is operatively arranged in the tool part to be movable in a direction other than a moving direction of the slide.

4. Press according to claim 1, wherein a restoring device is operatively associated with the forming element to act against the hydraulic force transmitting device.

5. Press according to claim 4, wherein the restoring device is a pneumatic spring.

6. Press according to claim 1, wherein the force transmitting device further comprises an overload protection device.

7. Press for operations which include massive forming, comprising:

a press frame with which a slide is movably disposed and is operatively connected with a driving device, a workpiece receiving space in which a tool having at least two tool parts is operatively arranged for deforming a workpiece in said press;

a forming device for which at least one forming element is movably arranged in one of the tool parts; and a driven hydraulic force transmitting device operatively connected with the forming element, wherein the hydraulic force transmitting device has a pumping device arranged to be actuated by the slide.

8. Press according to claim 7, wherein the hydraulic force transmitting device has a pressure element with which an element is operatively associated, connected with the slide and which arranged such as to be engageable and disengageable with and from the pressure element by movement of the slide.

9. Press for operations which include massive forming, comprising:

a press frame with which a slide is movably disposed and is operatively connected with a driving device, a workpiece receiving space in which a tool having at least two tool parts is operatively arranged for deforming a workpiece in said press;

a forming device for which at least one forming element is movably arranged in one of the tool parts; and a driven hydraulic force transmitting device operatively connected with the forming element, wherein a coupling device, which is configured to couple in and out as a result of slide movement, is arranged between the driving device and the force transmitting device.

10. Press for operations which include massive forming, comprising:

a press frame with which a slide is movably disposed and is operatively connected with a driving device, a workpiece receiving space in which a tool having at least two tool parts is operatively arranged for deforming a workpiece in said press;

a forming device for which at least one forming element is movably arranged in one of the tool parts; and a driven hydraulic force transmitting device operatively connected with the forming element, wherein one of the at least two tool parts, which contains the forming element, is unconnected with the slide.

11. Press for operations which include massive forming, comprising:

a press frame with which a slide is movably disposed and is opertively connected with a driving device, a workpiece receiving space in which a tool having at least two tool parts is operatively arranged for deforming a work piece in saidpres;

a forming device for which at least one forming element is movably arranged in one of the tool parts; and a driven hydraulic force transmitting device operatively connected with the forming element, wherein the forming element is a shearing member.

* * * * *